US005980340A

United States Patent [19]

Okamoto

[11] Patent Number: 5,980,340

[45] Date of Patent: Nov. 9, 1999

[54] LUBRICANT COOLING SYSTEM FOR A LUBRICATING SYSTEM OF AN OUTBOARD MOTOR

[75] Inventor: Yutaka Okamoto, Hamamatsu, Japan

[73] Assignee: Sanshin Kogyo Kabushiki Kaisha, Hamamatsu, Japan

[21] Appl. No.: 08/975,722

[22] Filed: Nov. 20, 1997

[30] Foreign Application Priority Data

Nov. 20, 1996 [JP] Japan ..... 8-323324

[51] Int. Cl.[6] ..... B63H 21/38

[52] U.S. Cl. ..... 440/88; 123/196 AB; 184/104.3

[58] Field of Search ..... 440/88; 184/6.22, 184/104.3; 123/196 AB

[56] References Cited

U.S. PATENT DOCUMENTS 3,493,081 2/1970 Tado ..... 440/88
4,669,988 6/1987 Breckenfeld et al. ..... 440/88
4,898,261 2/1990 Winberg et al. ..... 184/6.22
5,330,376 7/1994 Okumura ..... 440/88
5,647,315 7/1997 Saito ..... 123/196 AB

*Primary Examiner*—Sherman Basinger
*Attorney, Agent, or Firm*—Knobbe, Martens, Olson & Bear LLP

[57] ABSTRACT

A lubricant cooling system for cooling lubricant of a lubricating system for an outboard motor powered by an engine is disclosed. The motor has a cooling system which includes a pump for delivering coolant through one or more cooling jackets associated with the engine. The motor has a lubricating system comprising a pump for delivering lubricant from a supply to at least one part of the engine for lubricating the engine. The motor also includes a lubricant cooling system including a cooler through which lubricant flows and through which coolant from the cooling system selectively flows for cooling the lubricant. The lubricant cooling system includes a control for increasing a volume of coolant supplied to the lubricant cooler when a temperature of the lubricant increases and for decreasing a volume of coolant supplied to the lubricant cooler when said temperature of the lubricant decreases.

13 Claims, 4 Drawing Sheets

LUBRICANT COOLING SYSTEM FOR A LUBRICATING SYSTEM OF AN OUTBOARD MOTOR

FIELD OF THE INVENTION

The present invention relates to a lubricant system for an engine powering a watercraft. More particularly, the invention relates to a lubricant cooling arrangement for such a lubricant system.

BACKGROUND OF THE INVENTION

Watercraft are often propelled by an outboard motor. These motors have a water propulsion device, such as a propeller, which is driven by an output shaft of an internal combustion engine. The engine is typically mounted in a cowling of the motor.

The motor includes a lubricating system for providing lubricant to the engine. These systems are well known in the art, and arranged to provide lubricant from a supply to one or more galleries, bearings and the like of the engine for lubricating the various parts thereof.

When the lubricant in such a system is too cool or too hot, the effect of the lubricant is less than optimal. Typically, the optimum operating temperature range for the lubricant is in the 60° C. to 80° C. temperature range. When the temperature of the lubricant is less than this range, it is difficult to pump and flows less freely through the lubricating system and engine. On the other hand, when the temperature of the lubricant exceeds this range, the lubricant thins and becomes less effective in providing a protective lubricant film on the moving parts of the engine.

The problem of overheating the lubricant is especially a problem in outboard motor applications since the engine is positioned in an enclosed cowling, trapping engine heat. Some lubricant systems are provided with a lubricant cooling system to prevent the lubricant from becoming overheated. The cooling system of an outboard motor is generally arranged such that water from the body of water in which the motor is being operated is drawn by a pump and delivered through one or more cooling jackets associated with the engine and then discharged back to the body of water. In one lubricating cooling arrangement, lubricant is delivered through a delivery line which passes through a heat exchanger through which coolant from the cooling system of the motor also passes. In this arrangement, the fixed flow of coolant passing through the heat exchanger has the tendency of over-cooling the lubricant when the engine speed/temperature is low. As one attempt to correct this problem, the coolant flow rate through the heat exchanger may be fixed at a low rate which does not over-cool the lubricant. This arrangement has the problem of providing insufficient cooling to the lubricant when the engine temperature increases.

The problems associated with maintaining the lubricant temperature are aggravated in the outboard motor setting since the coolant may comprise extremely cold water from the ocean or a lake. In that situation, the coolant temperature is so low that when the lubricant temperature is low, the coolant lowers the lubricant temperature to an unacceptably low level.

SUMMARY OF THE INVENTION

The present invention is a lubricant cooling system for cooling lubricant of associated with a lubricating system for an outboard motor powered by an engine. Preferably, the outboard motor is of the type having the engine positioned in a cowling and an output shaft of the engine driving a water propulsion device of the motor.

The motor has a cooling system which includes a pump for delivering coolant through one or more cooling jackets associated with the engine. The motor has a lubricating system comprising a pump for delivering lubricant from a supply to at least one part of the engine for lubricating the engine.

In accordance with the present invention, the motor also includes a lubricant cooling system including a cooler through which lubricant flows and through which coolant from the cooling system selectively flows for cooling the lubricant. The lubricant cooling system includes a control for increasing a volume of coolant supplied to the lubricant cooler when a temperature of the lubricant increases and for decreasing a volume of coolant supplied to the lubricant cooler when said temperature of the lubricant decreases.

In one embodiment, the control comprises a valve which is actuated by an actuator based upon an output of a lubricant temperature sensor. In another embodiment, the control comprises a pressure control valve which controls the flow of coolant based upon the pressure of coolant in the coolant system, as related to the speed of the engine, and thus the temperature of it and the lubricant.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In general, the present invention relates to a lubricant cooling system. The lubricant cooling system is preferably used to cool lubricant of a lubricating system of an engine powering an outboard motor. The lubricant cooling system of the invention is described in conjunction with a lubricating system of an engine of an outboard motor since this is an application for which the system has particular utility. Those of skill in the art will appreciate that the system has use in a variety of other applications.

Figure 1:
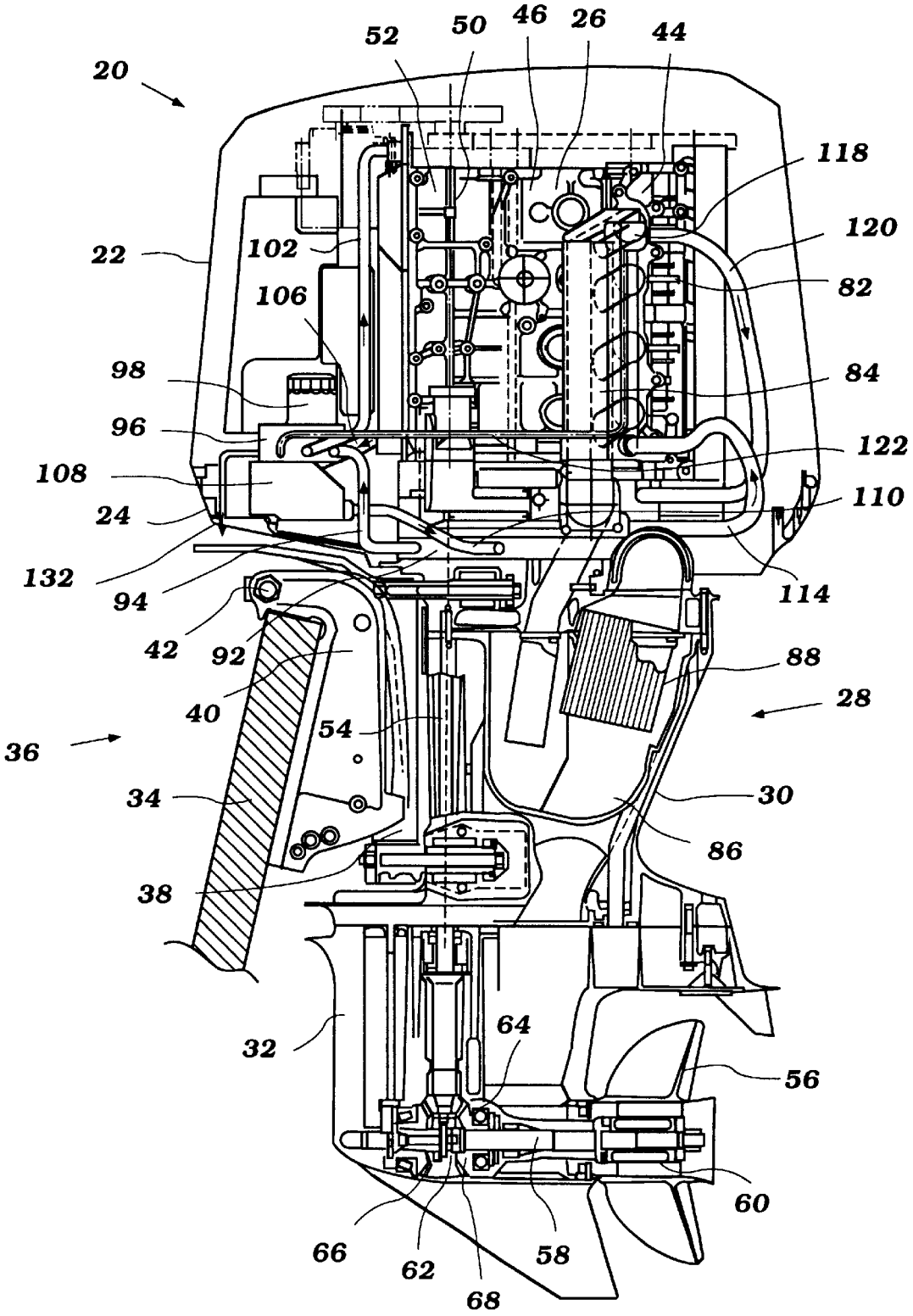
FIG. 1 is a cross-sectional side view of an outboard motor powered by an engine and having a lubricant cooling system in accordance with the present invention.

Referring to FIG. 1, an outboard motor 20 has a powerhead which comprises a main cowling 22 having a tray or skirt portion 24 positioned therebelow. The engine 26 is positioned within the cowling 22.

The outboard motor 20 includes a lower unit 28 extending below the powerhead. The lower unit 28 preferably includes a drive shaft housing portion 30 and a lower portion 32.

The outboard motor 20 is connected to a hull 34 of a watercraft 36, preferably at a transom portion of the watercraft 36 at the stern thereof. A steering shaft (not shown) is connected to the motor 20 and extending along a vertically extending axis through a swivel bracket 38. The mounting of the steering shaft with respect to the swivel bracket 38 permits the motor 20 to rotate about the vertical axis through the bracket 38, and thus be turned from side to side.

The swivel bracket 38 is connected to a clamping bracket 40 by means of a pivot pin 42 which extends along a generally horizontal axis. The clamping bracket 40 is connected to the watercraft hull 34. The mounting of the motor 20 with respect to the clamping bracket 40 about the pin 42 permits the motor 20 to be raised up and down or "trimmed."

The engine 26 is preferably of the four-cylinder variety, arranged in in-line fashion and operating on a four-cycle principle. As may be appreciated by those skilled in the art, the engine 20 may have a greater or lesser number of cylinders, may be arranged in other than in-line fashion and may operate on other operating principles, such as a two-cycle principle.

The engine 26 preferably comprises a cylinder head 44 connected to a cylinder block 46 and cooperating therewith to define the four cylinders 48. As is well known to those skilled in the art, a piston 47 is movably mounted in each cylinder 48 and cooperates with the cylinder block 46 and head 44 to define a combustion chamber. Each piston 47 is connected via a connecting rod 49 to a generally vertically extending crankshaft 50.

Preferably, the crankshaft 50 is positioned in a crankcase chamber 52 defined by a crankcase cover 51 connected to the cylinder block 46 at an end thereof opposite the cylinder head 44.

The crankshaft 50 extends to a point below the engine 26 where it is connected to a drive shaft 54. The drive shaft 54 extends through the lower unit 28 of the motor 20 and is arranged to drive a water propulsion device of the motor 20. As illustrated, the water propulsion device is a propeller 56.

Preferably, a propeller shaft 58 is connected to a hub 60 of the propeller 56. The drive shaft 54 is preferably arranged to drive the propeller shaft 58 through a conventional forward-neutral-reverse transmission 62 as known to those of skill in the art. As illustrated, the transmission 62 includes a bevel gear 64 mounted on the drive shaft 54 for selective engagement with forward or reverse bevel gears 64,66 mounted on the propeller shaft 58. A shift mechanism (not shown) is preferably provided for permitting an operator of the watercraft 36 to move the transmission in to the forward, neutral or reverse positions.

An intake system is provides air to each cylinder 48. Preferably, air is drawn from within the cowling 22 of the motor 20 through an intake of a surge tank 70. The air then flows to a throttle body 72. A throttle valve 74 is positioned in the throttle body 72 for controlling the flow of air to the engine 26. Air which passes past the valve 74 flows through an intake runner 76 to an intake passage leading through to the cylinder head 44 to an intake port 78 leading to the cylinder 48. Preferably, a runner 76 is provided corresponding to each cylinder 48 for providing air to a passage leading thereto.

A suitable fuel supply system provides fuel to each cylinder 48 for combustion therein with the air. An ignition system is preferably provided for initiating combustion. Such systems are well known to those of skill in the art.

An exhaust system is provided for routing the products of combustion from each cylinder 48. Preferably, exhaust flows through an exhaust port 80 leading from the cylinder 48 and through the cylinder head 44 to an exhaust manifold 82 having a passage therethrough. Preferably, the exhaust system defines an exhaust path from the manifold to an expansion chamber 86 positioned in the lower unit 32 and having a catalyst 88 therein, and thereon to a through-the-hub (of the propeller) discharge.

In accordance with the present invention, the engine 26 includes a lubricating system which provides lubricant to one or more portions of the engine. As used herein, the term "lubricant" is synonymous with "oil" and means materials useful as a lubricant, such as natural petroleum oil or synthetic oils or the like.

As described in more detail below, a lubricant cooling system is provided for cooling the lubricant of the lubricating system. In accordance with the invention, the rate of cooling of the lubricant is increased as the temperature of the lubricant increases, and decreases as the temperature of the lubricant decreases.

The lubricating system includes a lubricant supply 90, such as a lubricant tank positioned in the hull 34 of the watercraft 36. Means are provided for drawing lubricant from the tank and delivering it to the engine 26. Preferably, this means comprises a lubricant pump 92 which draws lubricant from the supply 90 and delivers it through a supply pipe 94 to an oil filter 98, oil temperature sensor 100, and thereon to through a lubricant line 102 to one or more lubricant galleries throughout the engine 26. Preferably, the lubricant passes through an oil cooler 96 positioned along the supply pipe 94 on its way to the oil filter 98. The oil cooler 96 is preferably a heat exchanger, wherein heat is transferred from the lubricant passing therethrough to coolant also passing therethrough (as described in more detail below).

The lubricant pump 92 is preferably driven by the drive shaft 54, and arranged to draw lubricant through a filtered inlet.

The lubricant 98 passes through the engine 26, preferably lubricating at least one camshaft 104. Though not described above, at least one camshaft 104 is preferably provided for actuating a valve which controls the flow of air through each intake port 78 and a valve controlling the flow of exhaust through each exhaust port 80, as is well known to those of skill in the art. The lubricant preferably drains through one or more return passages or pipes 106 to a sub-tank 108 and then through a pipe 110 back to the supply 90.

Figure 3:
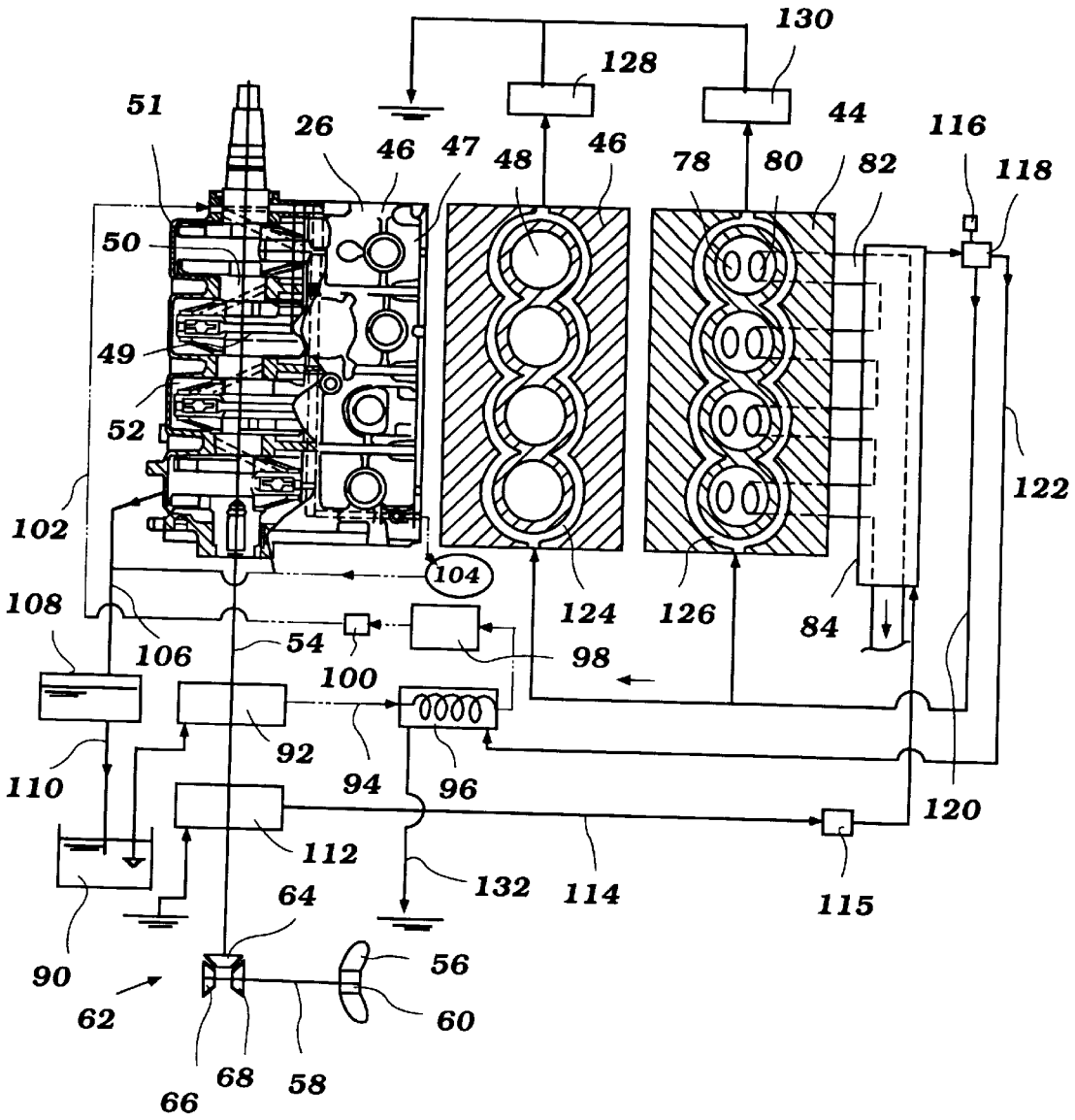
FIG. 3 is a schematic of the lubricant cooling system of the present invention, with related portions of the engine and motor illustrated.

In accordance with the present invention, a cooling system is provided for cooling various parts of the engine 26. As best illustrated in FIG. 3, the coolant preferably comprises water drawn from the body of water in which the watercraft 36 is operated. The coolant may comprise a man-made coolant or mixture thereof with water, in which case the coolant system is preferably closed.

In the embodiment illustrated, means are provided for drawing water from the body of water through an inlet in the motor 20 and delivering it to the engine 26. Preferably, this means comprises a coolant pump 112. The pump 112 is preferably positioned in the lower unit 32 of the motor 20 and driven by the drive shaft 54. The pump 112 delivers coolant through a delivery line 114 to a cooling jacket 84 of the exhaust manifold 82. Preferably, a coolant pressure sensor 115 is positioned along the delivery line 114 for sensing the pressure of the coolant in the coolant system.

The coolant then flows through a control valve 118 which is actuated by an actuator 116. The valve 118 is arranged to deliver coolant supplied through the delivery line 115 to a first coolant line 120 leading to the engine 26 and/or a second line 122 leading through the lubricant cooler 96. The valve 118 is preferably of the type which can be positioned to divert the entire flow of coolant into either the first or second lines 120,122, or to divide the flow so that some coolant flows through each line 120,122.

The coolant supplied to the first line 120 flows to a coolant jacket 124,126 for cooling the cylinder block 46 and head 44, respectively. After flowing through these coolant jackets 124,126, the coolant selectively flows through a thermostat 128,130 to a respective coolant discharge through the motor 20 back to the body of water in which the motor 20 is being operated. The thermostats 128,130 are preferably arranged so that when the coolant (and thus engine) temperature is low, the flow of coolant through the coolant jackets 124,126 of the engine 26 is slowed or stopped to allow the engine to heat up. When the engine 26, and thus the coolant, is warm, the thermostats 128,130 open to permit coolant to flow through the coolantjackets 124,126 to the discharge.

The coolant delivered to the second line 122 flows to the lubricant cooler 96, where the coolant cools the lubricating oil passing through therethrough. The coolant then flows through a discharge 132 to a point external to the motor 20.

Preferably, the actuator 116 is arranged to control the valve 118 in a specific manner. In particular, the actuator 116 is arranged to control the valve 118 to increase the flow rate of coolant through the second line 120 (to the lubricant cooler 96) as the temperature of the lubricant increases, and to decrease the flow rate of coolant through the second line 120 as the temperature of the lubricant decreases.

In the present embodiment, the temperature of the lubricant is monitored by the lubricant temperature sensor 100, and a control unit (which may be part of the actuator 116) is arranged to control the valve actuator 116 to move the valve 118 based on the sensed temperature.

In accordance with the present invention, when the lubricant temperature is low, the lubricant is not cooled or is cooled very little. In this manner, the lubricant temperature is not cooled below the preferred low operating temperature level. Once the lubricant temperature rises, the coolant flow rate is increased to keep the operating temperature of the lubricant within the desired high temperature limit.

Figure 2:
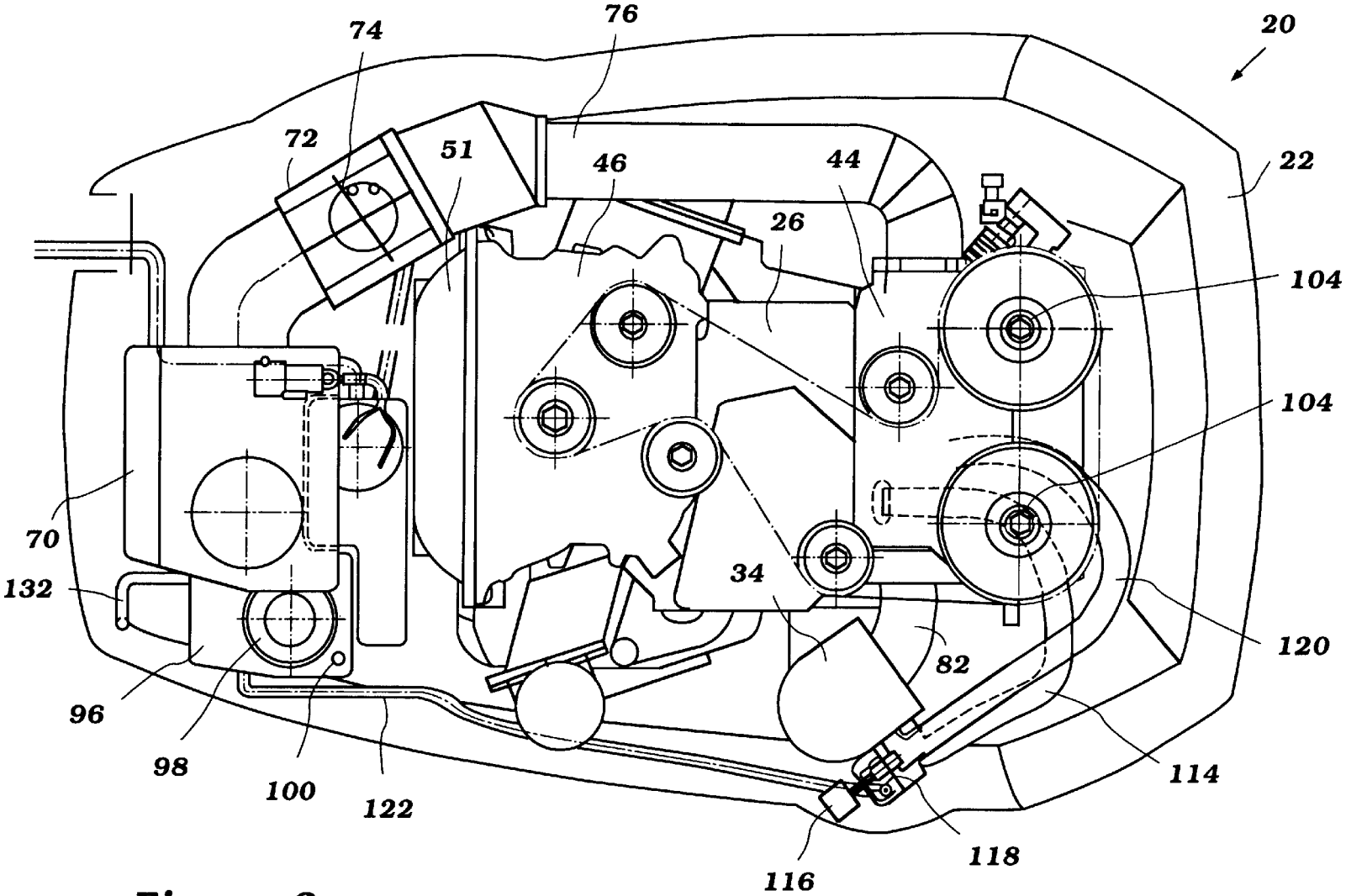
FIG. 2 is a cross-sectional top view of the motor illustrated in FIG. 1.
Figure 4:
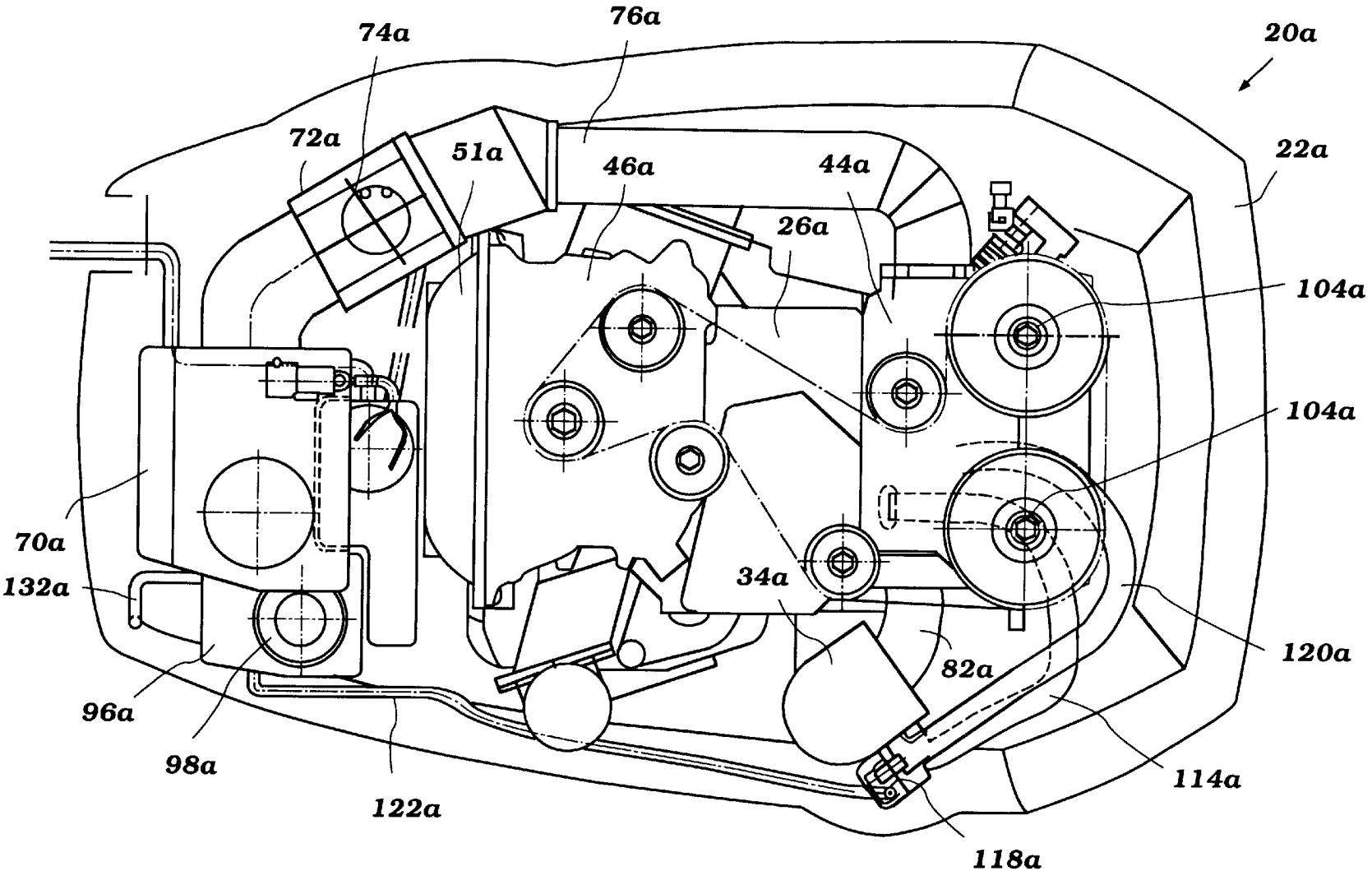
FIG. 4 is a cross-sectional top view of a motor powered by an engine and having a lubricant cooling system in accordance with an alternate embodiment of the present invention.

FIG. 4 illustrates an alternate embodiment lubricant cooling system in accordance with the present invention. This embodiment of the invention is similar to the first described above and illustrated in FIGS. 1–3 in many respects, and as such like or similar parts have been given like reference numbers to those used therein, except that an "a" designator has been added to all of the reference numerals of this embodiment.

This embodiment lubricant cooling system is similar to the last. In this embodiment, however, no lubricant temperature sensor (element 100 in the previous embodiment) is provided. Further, the combined actuator and valve (elements 116 and 118 in the previous embodiment) are replaced by a single pressure control valve 134*a* which controls the flow of coolant from the delivery line 114*a* through the line 122*a* to the lubricant cooler 96*a*.

In this arrangement, the coolant pump (not shown) is preferably again driven by the crankshaft of the engine 26*a* so that the flow of coolant increases as the speed of the engine increases. In this embodiment, as the coolant pressure in the delivery line 114*a* increases, the pressure valve 134*a* is arranged to deliver more coolant to the line 122*a* leading to the lubricant cooler 96*a*. In this manner, as the engine speed increases and the lubricant temperature correspondingly increases, the flow rate of the coolant to the cooler 96*a* increases to keep the lubricant temperature from exceeding a high temperature.

On the other hand, when the coolant pressure in the line 114*a* decreases, the pressure valve 134*a* moves towards a closed position, decreasing the flow of coolant to the cooler 96*a* In this manner, when the engine 26*a* is operating a low speed and the lubricant is cooler, the cooling rate is low as well, allowing the lubricant to be maintained above the lowest desirable operating temperature.

In accordance with the embodiments of the present invention, the rate of lubricant cooling is adjusted based upon the temperature of the lubricant (as measured directly or indirectly) so that the lubricant is maintained in the desired operating temperature range. Other means are contemplated for this purpose other than the pressure valve (114*a*) and control valve (118) described above, as known to those skilled in the art.

Of course, the foregoing description is that of preferred embodiments of the invention, and various changes and modifications may be made without departing from the spirit and scope of the invention, as defined by the appended claims.

What is claimed is:

1. An internal combustion engine for use in powering an outboard motor, the engine having a cooling system which includes means for delivering coolant through one or more cooling jackets associated with said engine, said engine including a lubricating system comprising a lubricant supply reservoir, means for delivering lubricant from said lubricant supply reservoir to at least one part of said engine for lubricating said engine and means for returning lubricant from said at least said one part of said engine to said lubricant supply reservoir, said lubricating system including a lubricant cooler interposed between said lubricant supply reservoir and said one part of said engine for cooling the circulated lubricant by coolant from said cooling system, said cooling system including means for increasing a volume of coolant supplied to said lubricant cooler when a temperature of said lubricant increases and for decreasing a volume of coolant supplied to said lubricant cooler when said temperature of said lubricant decreases.

2. The engine in accordance with claim 1, wherein said means for increasing and decreasing comprises a temperature sensor for sensing a temperature of said lubricant and a control valve for controlling the rate of flow of coolant from a first coolant line of said coolant system to a second coolant line leading to said lubricant cooler.

3. The engine in accordance with claim 1, wherein said means for increasing and decreasing comprises a pressure valve for controlling the flow of coolant through a coolant line leading to said lubricant cooler.

4. The engine in accordance with claim 1, wherein said lubricant cooler comprises a heat exchanger with a least one pipe through which said lubricant flows and at least one second pipe through which said coolant flows.

5. An outboard motor having a water propulsion device and an engine positioned in a cowling and having an output shaft in driving arrangement with a drive shaft driving said water propulsion device, said outboard motor having a cooling system, said cooling system including a coolant pump for drawing coolant from a body of water in which said outboard motor is operating and delivering said coolant to at least one cooling jacket of said engine, and a lubricating system including a lubricant pump for drawing lubricant from a lubricant supply and delivering said lubricant to at least one lubricant passage associated with said engine, and a lubricant cooling system including a lubricant cooler in heat exchanging relation with said lubricant and through which coolant selectively passes after having passed through at least a portion of said engine cooling jacket for cooling said lubricant, and a control for controlling the rate of flow of coolant through said cooler based on a temperature of said lubricant.

6. The outboard motor in accordance with claim 5, wherein said coolant pump is driven by said drive shaft, and wherein said control includes a pressure valve controlling the flow of coolant to said cooler based upon a pressure of coolant supplied by said coolant pump.

7. The outboard motor in accordance with claim 5, wherein said lubricating system includes a lubricant temperature sensor and said control includes a valve for controlling the flow of coolant to said cooler based upon an output of said sensor.

8. The outboard motor in accordance with claim 5, wherein said portion of said engine cooling jacket comprises a portion in heat exchanging relation with a portion of the exhaust system of said engine.

9. The outboard motor in accordance with claim 7, wherein including an actuator for controlling said valve.

10. The outboard motor in accordance with claim 5, wherein said cooling system includes a first coolant line extending from said pump to said at least one cooling jacket, and a second line extending from said first line to said cooler, and wherein said control controls the rate of coolant flow through said second line.

11. The engine in accordance with claim 1, wherein the coolant delivered to said lubricant cooler is drawn from a body of water in which the outboard motor is operating and returned to the body of water.

12. The engine in accordance with claim 11, wherein at least one of the cooling jackets of said engine is for a highly heated portion of said engine and coolant from a downstream portion of said one of said cooling jackets is supplied to the lubricant cooler.

13. The engine in accordance with claim 12, wherein the one engine cooling jacket is for an exhaust manifold of said engine.

* * * * *